US010288337B2

(12) United States Patent
Blezard et al.

(10) Patent No.: US 10,288,337 B2
(45) **Date of Patent: *May 14, 2019**

(54) TEMPERATURE CONTROLLED PRODUCT SHIPPER

(71) Applicant: Packaging Technology Group, Inc., Fall River, MA (US)

(72) Inventors: William C. Blezard, Mattapoisett, MA (US); George Hatch, Taunton, MA (US)

(73) Assignee: Packaging Technology Group, Inc., Fall River, MA (US)

( * ) Notice: Subject to any disclaimer, the term of this patent is extended or adjusted under 35 U.S.C. 154(b) by 92 days.

This patent is subject to a terminal disclaimer.

(21) Appl. No.: 15/014,428

(22) Filed: Feb. 3, 2016

(65) Prior Publication Data

US 2016/0161171 A1 Jun. 9, 2016

Related U.S. Application Data

(63) Continuation of application No. 13/891,259, filed on May 10, 2013, now Pat. No. 9,267,722.

(51) Int. Cl.
*F25D 3/08* (2006.01)
*B65D 81/38* (2006.01)
(Continued)

(52) U.S. Cl.
CPC ..... *F25D 3/08* (2013.01); *B65B 3/04* (2013.01); *B65B 7/2821* (2013.01); *B65B 39/00* (2013.01);
(Continued)

(58) Field of Classification Search
CPC ..... F25D 3/08; F25D 2303/0843; F25D 2303/0844; F25D 2331/804; F25D 2303/08222; F25D 2303/082; F25D 2303/0821; F25D 2303/0832; F28D 20/02; B65D 81/18; B65D 81/3813;
(Continued)

(56) References Cited

U.S. PATENT DOCUMENTS 2,303,369 A 12/1942 Kleist
3,974,658 A * 8/1976 Starrett ..... B65D 25/02 62/60

(Continued)

FOREIGN PATENT DOCUMENTS

GB 485247 6/1937

OTHER PUBLICATIONS

Extended European search report, Application No. 14794286.6-1605/2994704—PCT/US201403743, dated Mar. 9, 2017.

*Primary Examiner* — Frantz F Jules
*Assistant Examiner* — Lionel Nouketcha
(74) *Attorney, Agent, or Firm* — Barlow, Josephs & Holmes, Ltd.

(57) ABSTRACT

A temperature controlled product shipper includes a phase change material bladder which can be filled at the point of packaging. The shipper includes an internal product box and an outer box where the product box is received within the outer box. The phase change material bladder is received within a cavity defined between the outer surface of the product box and the inner surface of the outer box. The shipper may also include an insulated liner which is received between the product box and the bladder.

15 Claims, 11 Drawing Sheets

(51) Int. Cl.

| | |
|---|---|
| ***B65D 21/02*** | (2006.01) |
| ***B65B 3/04*** | (2006.01) |
| ***B65B 7/28*** | (2006.01) |
| ***B65B 39/00*** | (2006.01) |
| ***B65B 63/08*** | (2006.01) |
| ***B65D 39/00*** | (2006.01) |
| ***B65D 81/18*** | (2006.01) |
| *F28D 20/02* | (2006.01) |

(52) U.S. Cl.
CPC ..... *B65B 63/08* (2013.01); *B65D 21/022* (2013.01); *B65D 21/0202* (2013.01); *B65D 39/0005* (2013.01); *B65D 81/18* (2013.01); *B65D 81/3813* (2013.01); *F25D 2303/0843* (2013.01); *F25D 2303/0844* (2013.01); *F25D 2303/08222* (2013.01); *F25D 2331/804* (2013.01); *F28D 20/02* (2013.01)

(58) Field of Classification Search
CPC ..... B65D 21/0202; B65D 21/022; B65D 39/005; B65D 21/0234; B65B 39/00; B65B 3/04; B65B 63/08
USPC ..... 62/457.2; 220/23.83
See application file for complete search history.

(56) References Cited

U.S. PATENT DOCUMENTS 4,579,170 A 4/1986 Moses et al.
4,869,398 A * 9/1989 Colvin ..... A61J 1/1462 222/105
4,924,935 A 5/1990 Van Winckel
4,936,102 A * 6/1990 Goldstein ..... A23B 4/066 62/240
5,235,819 A * 8/1993 Bruce ..... F25D 3/06 62/438
5,435,142 A 7/1995 Silber
5,564,570 A * 10/1996 Jaszai ..... B65D 81/1075 206/213.1
6,308,518 B1 * 10/2001 Hunter ..... F25B 21/02 62/3.3
6,868,982 B2 3/2005 Gordon
6,875,486 B2 4/2005 Miller
7,051,550 B2 * 5/2006 Roth ..... F25D 3/08 62/457.2
7,240,513 B1 7/2007 Conforti
7,500,593 B2 * 3/2009 Mayer ..... B65D 81/3816 220/592.2
7,681,405 B2 3/2010 Williams
7,802,446 B2 9/2010 Overgaard
9,751,682 B2 * 9/2017 Mayer ..... B65D 81/3825
2003/0052786 A1 * 3/2003 Dickinson ..... B65D 5/4233 340/572.8
2003/0160092 A1 * 8/2003 Philips ..... B65D 77/065 229/122.32
2004/0068290 A1 * 4/2004 Bates ..... A61B 17/12 606/202
2004/0123391 A1 6/2004 Call
2005/0249570 A1 * 11/2005 Deonarine ..... B60P 7/065 410/119
2007/0028642 A1 2/2007 Glade et al.
2008/0135564 A1 6/2008 Romero
2008/0164265 A1 7/2008 Conforti
2008/0202128 A1 8/2008 Flanagan
2008/0264063 A1 * 10/2008 Linares ..... F01D 1/34 60/721
2008/0289302 A1 * 11/2008 Vulpitta ..... B65D 81/051 53/472
2011/0072847 A1 3/2011 Crespo et al.
2011/0168727 A1 * 7/2011 Williams ..... F25D 3/08 220/592.26
2012/0248101 A1 * 10/2012 Tumber ..... B65D 81/05 220/1.5
2013/0026052 A1 * 1/2013 Tompkins ..... A42B 3/122 206/8
2013/0055750 A1 * 3/2013 Mustafa ..... B65D 81/3862 62/457.2

* cited by examiner

TEMPERATURE CONTROLLED PRODUCT SHIPPER

CROSS-REFERENCE TO RELATED APPLICATIONS

This application is a continuation of, and the claims the benefit of, U.S. application Ser. No. 13/891,259, filed May 10, 2013, the entire contents of which are incorporated herein by reference.

FIELD OF THE INVENTION

The instant invention relates to temperature controlled product shippers, and more particularly to a phase change material (PCM) bladder for use in a temperature controlled product shipper. More specifically, the invention relates to a PCM bladder or bladder system for use in a "cold-chain" product shipper.

SUMMARY OF THE INVENTION

Throughout this specification, the exemplary embodiments refer to product shippers which are typically maintained at controlled temperatures below ambient temperature, i.e. cold-chain applications. However, while the focus of the exemplary embodiments is on "cold chain" packaging, it is to be understood that the concepts as disclosed herein are equally applicable to product shippers which are to be maintained at controlled temperatures above ambient, even though not specifically discussed herein.

Currently, phase change materials (PCM's) in the form of gel packs or gel bricks are used to heat or cool the interior of a temperature controlled product shipper. Engineers calculate the heat loss of a product shipper design based on a client's desired "target" temperature. The engineers then use a mixture of "ambient" temperature gel packs and "frozen" or "heated" gel packs to achieve the desired results. Before use, the gel packs must be preconditioned to a temperature designated by the engineer who designed the package. For example, in most cold chain applications, there are two temperatures used: −20° C. and +5° C.

As indicated above, the most advantageous use of the invention is in cold chain applications, because there is a tremendous expense involved in pre-conditioning these gel packs at the desired temperatures and then maintaining the gel packs at temperature prior to pack-out.

In this regard, the instant invention provides a novel phase change material (PCM) bladder which is designed and configured to receive and hold a flowable PCM at the point of packaging, thus completely eliminating the need to precondition and store large volumes of PCM gel packs.

In a first embodiment, the PCM bladder includes a single bladder chamber having a filling port. The bladder is constructed from overlaid polyethylene sheets which are heated sealed around the peripheral edges. The filling port comprises a filling bung which is sealed to the top sheet and a stopper removably seated in the bung hole. To accommodate the rectangular shape of most typical product boxes, the bladder is formed in the shape of a cross including a central body portion and appendage portions extending outwardly therefrom. The central portion and appendage portions effectively overlay five (5) of the six (6) sides of the product box. An alternate version is asymmetrical and effectively overlays all six (6) sides of the product box. The bladder chamber is configured so that it has a substantially uniform thickness when filled with the flowable PCM whereby the bladder provides a substantially uniform thermal profile around all sides of the product box.

In a second embodiment, a PCM bladder system is provided comprising two discrete PCM bladders which are overlaid in coextensive relation to provide a desired thermal profile. The first bladder receives a PCM pre-conditioned at a first temperature while the second bladder receives a PCM pre-conditioned at a second temperature. The first, or inner, bladder includes a first filling port sealed on the upper sheet, while the second, or outer, bladder includes a second filling port sealed on the upper sheet and further includes an aperture through which the first filling port extends when the second bladder is overlaid on top of the first bladder. Both bladders are formed in the shape of crosses in the exemplary embodiments.

In a third embodiment, a dual chamber PCM bladder is provided in a single heat sealed construction. The dual chamber PCM bladder comprises a first bladder chamber having a first filling port and a second bladder chamber having a second filling port. Each bladder receives a flowable PCM preconditioned at a predetermined temperature. The bladder comprises a lower sheet, a middle sheet and an upper sheet overlaid in substantially coextensive relation and sealed around the peripheral edges thereof. The first bladder chamber is defined between the lower sheet and the middle sheet and the second bladder chamber is defined between the middle sheet and the upper sheet. The first filling port is sealed on the upper surface of the middle sheet and the upper sheet is sealed around the peripheral edge of the first filling port. The second filling port is sealed on the upper surface of the upper sheet whereby the first and second filling ports are both accessible for filling from above the upper surface of the upper sheet. The bladder is preferably formed in the shape of a cross as described hereinabove.

A fourth embodiment comprises a PCM bladder that includes a plurality flutes which divide the chamber, or chambers, into a plurality of sections for greater support and stability of the bladder.

A fifth embodiment comprises a more rigid blow molded box structure which is open at the top for receiving the product box therein.

Accordingly, among the objects of the instant invention are: the provision of a phase change material bladder for use in a temperature controlled product shipper; the provision of a PCM bladder that receives and holds a flowable PCM; the provision of a bladder having a filling port that can be selectively accessed for filling of the bladder chamber with a PCM at the point of packing; the provision of a bladder system including overlaid first and second bladders which received PCM's preconditioned at two different temperatures; the provision of a dual chamber PCM which provides two different PCM's in a single layered construction; and the provision of a PCM bladder including flutes which divide the bladder chamber into a plurality of sections to provide support and stability to the structure.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE EXEMPLARY EMBODIMENTS

Figure 1:
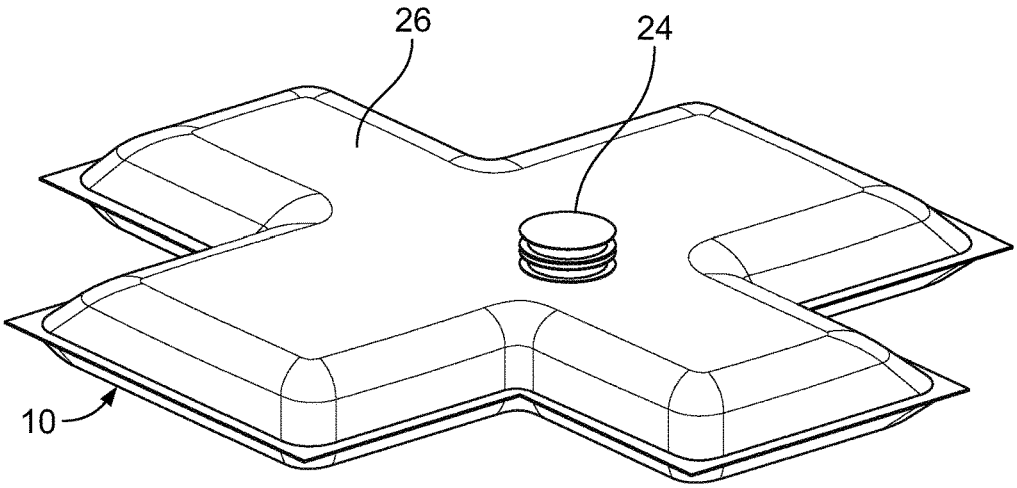
FIG. 1 is a perspective view of a first embodiment of a phase change material (PCM) bladder constructed in accordance with the teachings of the present invention.

Referring now to the drawings, a first embodiment of a phase change material bladder of the instant invention is illustrated and generally indicated at 10 in FIGS. 1-6. As will hereinafter be more fully described, the instant invention provides a novel phase change material (PCM) bladder which is designed and configured to receive and hold a "flowable PCM" 12 at the point of packaging, thus completely eliminating the need to pre-condition and store PCM gel packs.

The term "phase change material" (PCM) as used within the specification refers to a material having a high heat of fusion which, when melting or solidifying at a certain temperature, is capable of storing and releasing large amounts of energy. Heat is absorbed or released when the material changes from solid to liquid and vice-versa.

The term "flowable PCM" as used within the specification refers to a PCM material which can be pumped with conventional pumping devices from a storage tank or container into the PCM bladder 10 as described herein. At the present time, the exemplary embodiment of a "flowable PCM" comprises a "slurry ice" material that is produced on-site and pumped through insulated hoses to a filling head. However, the inventive concepts herein should not be limited to any specific "flowable PCM".

In the present disclosure, slurry ice is produced by a crystal ice generator (not shown) and held in a storage tank (not shown). A brine is incorporated into the "ice" solution to increase the "flowability" of the "ice" solution. Pumping stations (not shown) are employed to deliver the slurry ice to pack-out stations as needed.

Figure 5:
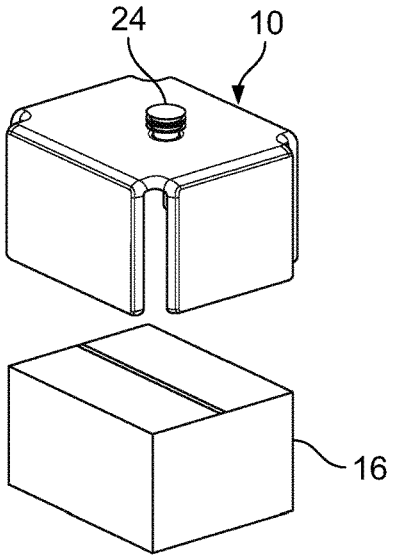
FIG. 5 is a perspective view of the PCM bladder and a representative product box where the PCM bladder overlays five (5) of the six (6) sides of the product box.
Figure 6:
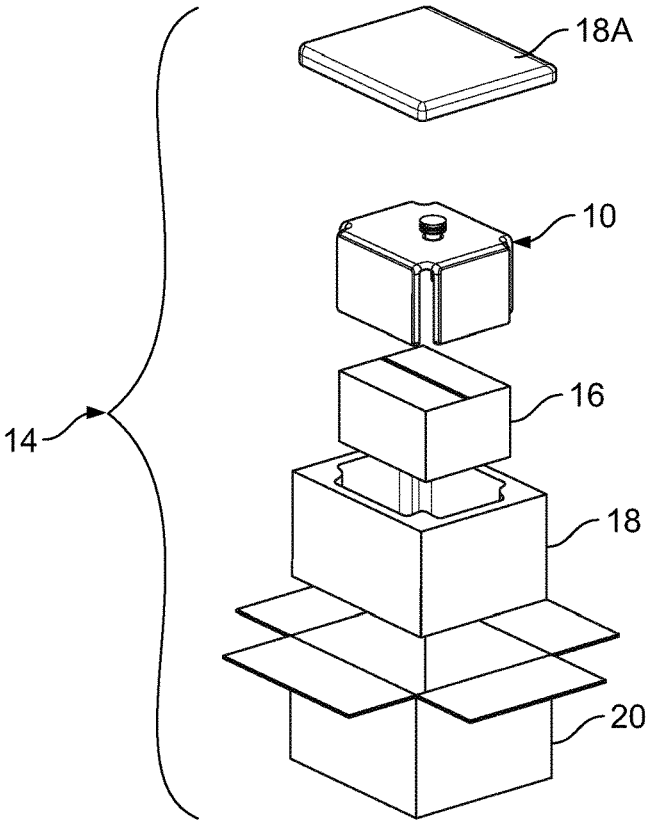
FIG. 6 is an exploded perspective view of a temperature controlled product shipper including the PCM bladder of the present invention.

Referring briefly to FIGS. 5 and 6, the present PCM bladder 10 is designed to be useful in a temperature controlled product shipper generally indicated at 14. The product shipper 14 comprises an interior product box 16, or mastercase, as it is sometimes called, an insulated liner 18 (which includes a lid 18A) and an outer box 20. The product box 16 is designed to hold the "temperature sensitive product". The product box 16 is received inside the insulated liner 18, and the PCM bladder 10 is received into a space defined between the inside surface of the insulated liner 18 and the outside surface of the product box 16.

Turning now to the PCM bladder 10, in a first embodiment, the PCM bladder 10 includes a single bladder chamber 22 having a filling port 24. The bladder 10 is constructed from polyethylene sheets 26, 28 which are overlaid in substantially coextensive adjacent relation and heated sealed around the peripheral edges to form the interior bladder chamber 22. Referring to FIG. 2A, the bladder chamber 22 is configured so as to have a substantially uniform thickness "t" across its extent when filled with the flowable PCM 12.

Figure 4:
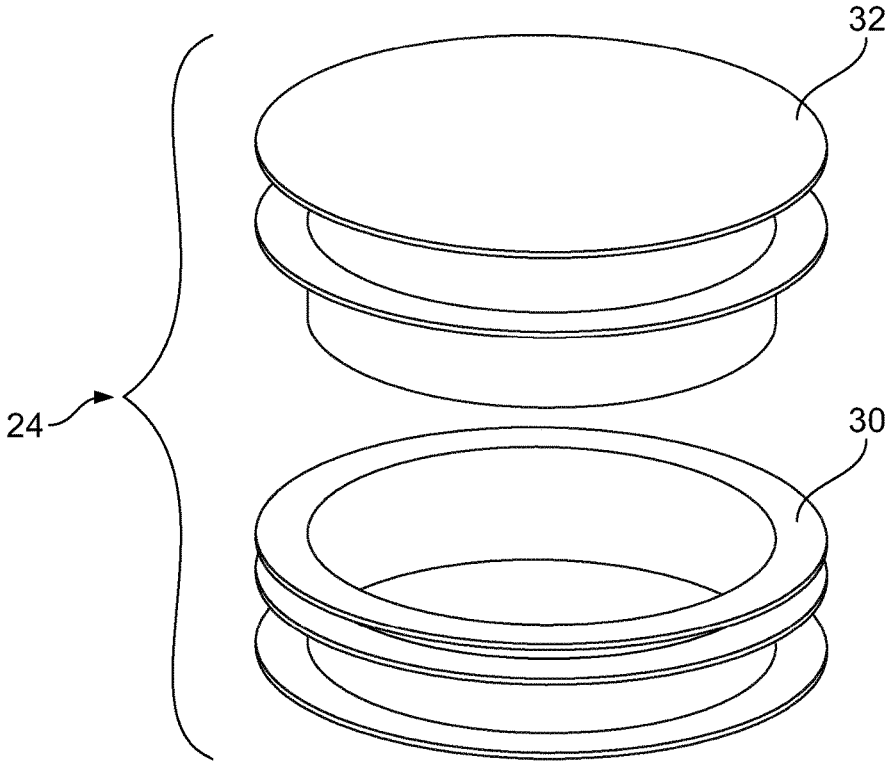
FIG. 4 is a perspective view of a filling port.

The filling port 24 comprises a filling bung 30 which is sealed to the top sheet 26 and a stopper 32 removably seated in the bung hole 34 (FIG. 4). It is noted that the PCM bladder 10 is intended to be filled at the point of shipment, where the PCM bladder 10 is inserted into the shipper 14 with the liner lid 18A off and outer box 20 still open. In this regard, the filling port 24 is presented for filling on the top of the shipper 14 where it can be accessed by an automated filling apparatus (not shown). In use, the filling bung 30 is grabbed by an automated, robotic filling head which removes the stopper 32, fills the bladder chamber 22 with a desired PCM 12, and replaces the stopper 32. It should be noted that a variety of different types of filling ports 24 can be utilized depending on the application and needs of the end user, and the concepts herein should not be limited only to a filling bung with a removable stopper.

Figure 2:
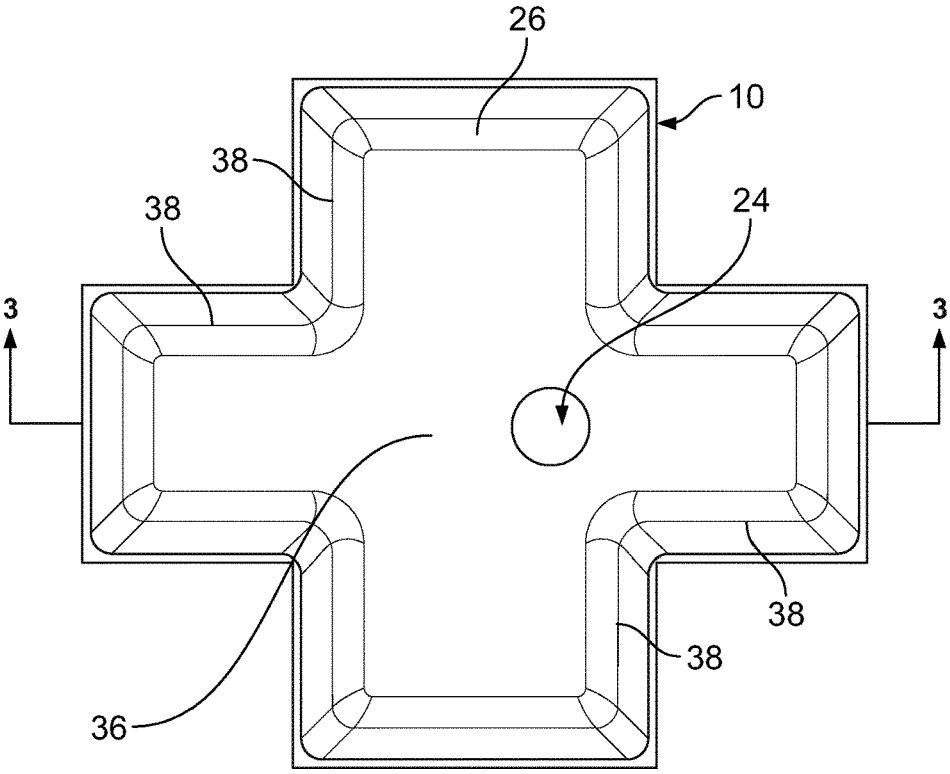
FIG. 2 is top view thereof.
Figure 3:
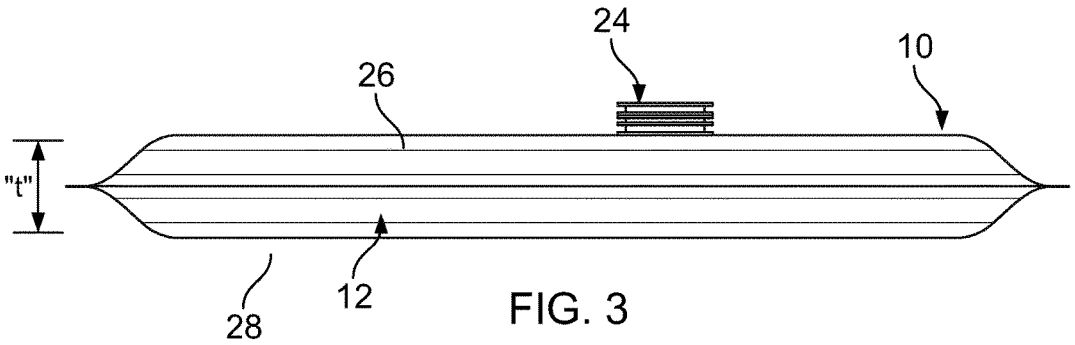
FIG. 3 is a cross-sectional view thereof taken along line 3-3 of FIG. 2.

To accommodate the rectangular shape of most typical product boxes 16, the bladder 10 is formed in the shape of a cross including a central body portion 36 and appendage portions 38 extending outwardly therefrom (See FIG. 2). The central body portion 36 and appendage portions 38 effectively overlay five (5) of the six (6) sides of the product box 16 (See FIG. 5).

Figure 7:
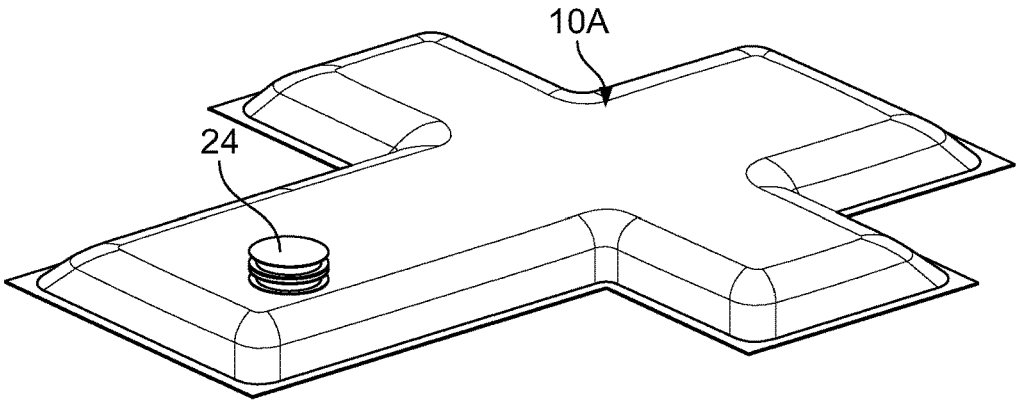
FIG. 7 is a perspective view of an asymmetrical PCM bladder effective for overlaying six (6) sides of the product box.
Figure 8:
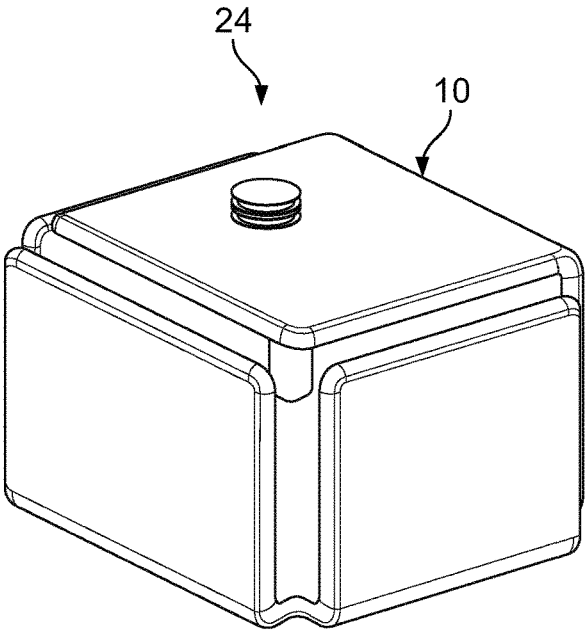
FIG. 8 is another perspective view thereof as shown in its deployed configuration.

An alternate version indicated at 10A in FIGS. 7 and 8, is asymmetrical and effectively overlays all six (6) sides of the product box 16. The bladder chamber 22 in this version is also configured so that it has a substantially uniform thickness when filled with the flowable PCM 12 whereby the bladder 10A provides a substantially uniform thermal profile around all six (6) sides of the product box (See FIG. 8).

While the exemplary embodiment illustrated a rectangular shaped product box 16 and associated shape for the PCM bladder 10, it should be understood that the shape of the bladder 10 may be altered to accommodate other product box shapes, such as for example, a cylinder. In the case of a cylindrical product box (not shown), the PCM bladder may comprise a circular central portion and appendages which extend radially outward from the central portion.

Figure 9:
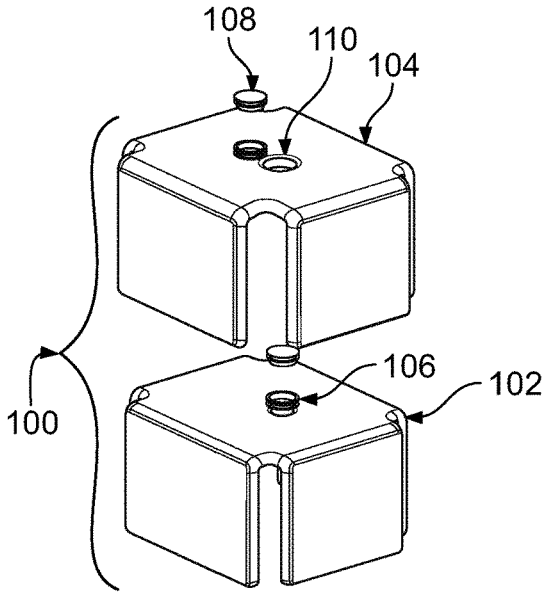
FIG. 9 is a perspective view of a second embodiment comprising a PCM bladder system having two discrete PCM bladders which are overlaid in coextensive relation.
Figure 10:
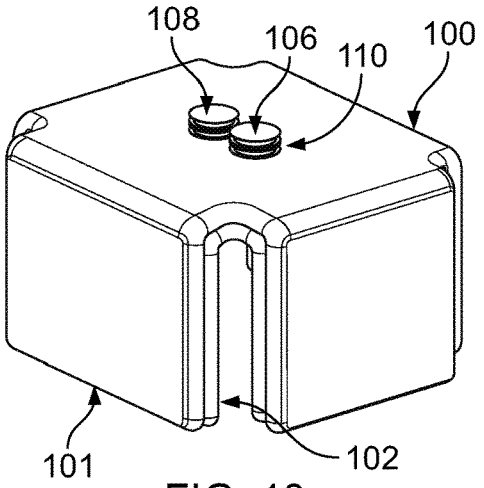
FIG. 10 is another perspective view thereof as shown in their deployed configurations.
Figure 11:
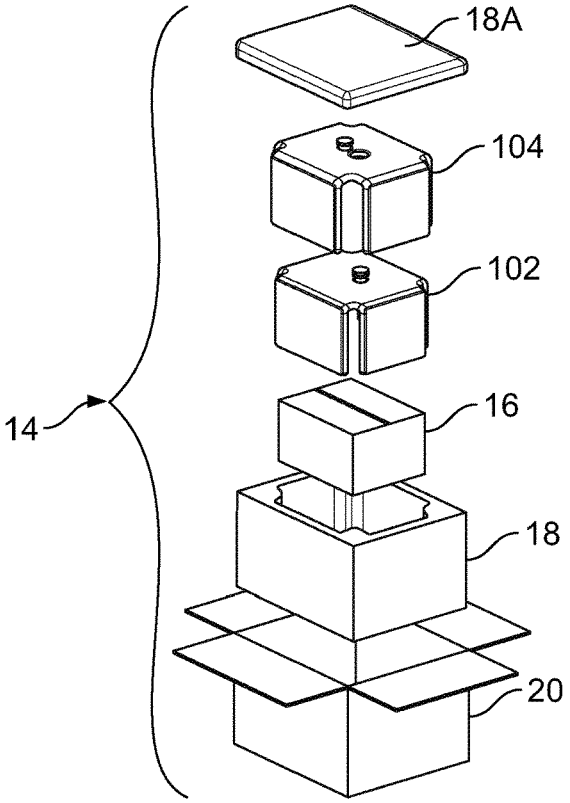
FIG. 11 is an exploded perspective view of a temperature controlled product shipper including the present 5-sided PCM bladder system.

Referring now to FIGS. 9-11, in a second embodiment, a PCM bladder system 100 comprises two discrete PCM bladders 102, 104 which are overlaid in coextensive relation and cooperate to provide a desired thermal profile. The bladders 102, 104 are constructed in the same manner as in the first embodiment described above. However, the first bladder 102 receives a PCM pre-conditioned at a first temperature while the second bladder 104 receives a PCM pre-conditioned at a second temperature.

Referring to FIG. 9, the first, or inner, bladder 102 includes a first filling port 106 sealed on the upper sheet, while the second, or outer, bladder 104 includes a second filling port 108 sealed on the upper sheet and an aperture 110 through which the first filling port 106 extends when the second bladder 104 is overlaid on top of the first bladder 102 (See FIG. 10). Both bladders 102, 104 are formed in the shape of crosses in the exemplary embodiments to overlay 5 outer sides of the product box 16. The dual bladder PCM system 100 is received into a product shipper 14 as described hereinabove (See FIG. 11).

Figure 12:
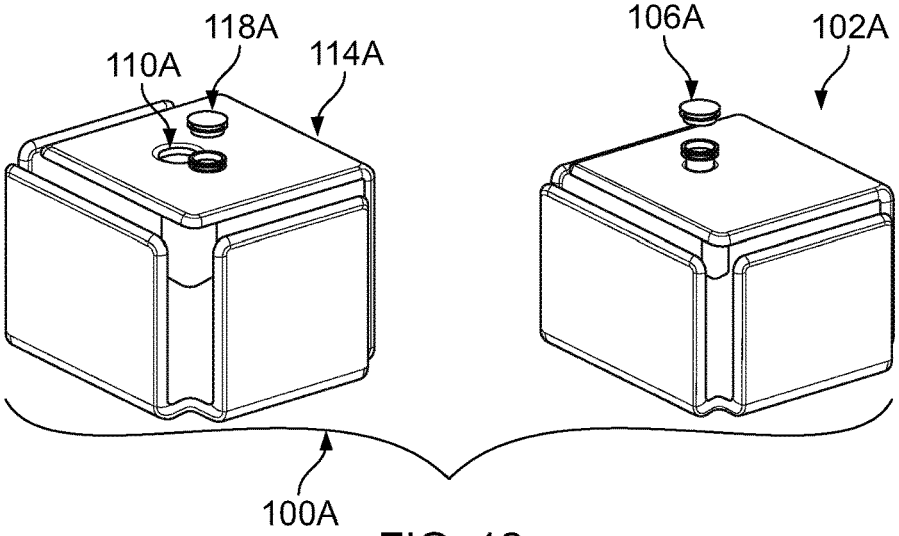
FIG. 12 is a perspective view of an asymmetrical PCM bladder system effective for overlaying six (6) sides of the product box.
Figure 13:
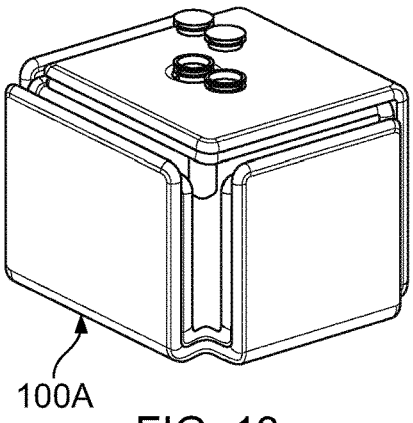
FIG. 13 is another perspective view thereof as shown in their deployed configurations.
Figure 14:
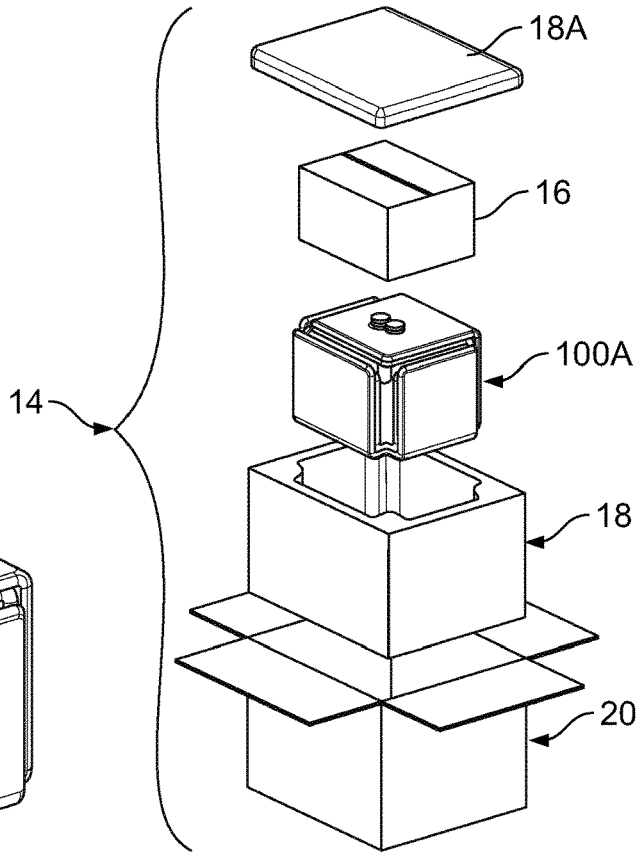
FIG. 14 is an exploded perspective view of a temperature controlled product shipper including the 6-sided PCM bladder system.

An alternate version indicated at 100A in FIGS. 12-14, provides asymmetrical first and second PCM bladders 102A and 104A and effectively overlays all six (6) sides of the product box 16. The six-sided, dual-bladder PCM system 100A is also received into a product shipper 14 as described hereinabove (See FIG. 14).

Figure 15:
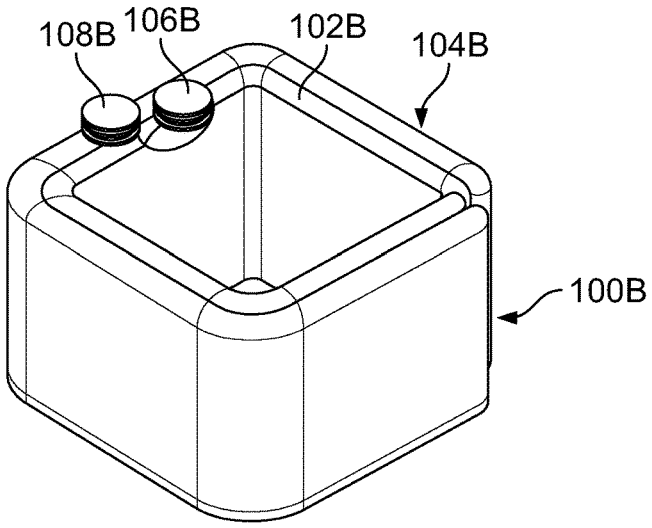
FIG. 15 is a perspective view of another alternative bladder system effective for overlaying the four side surfaces of the product box.
Figure 16:
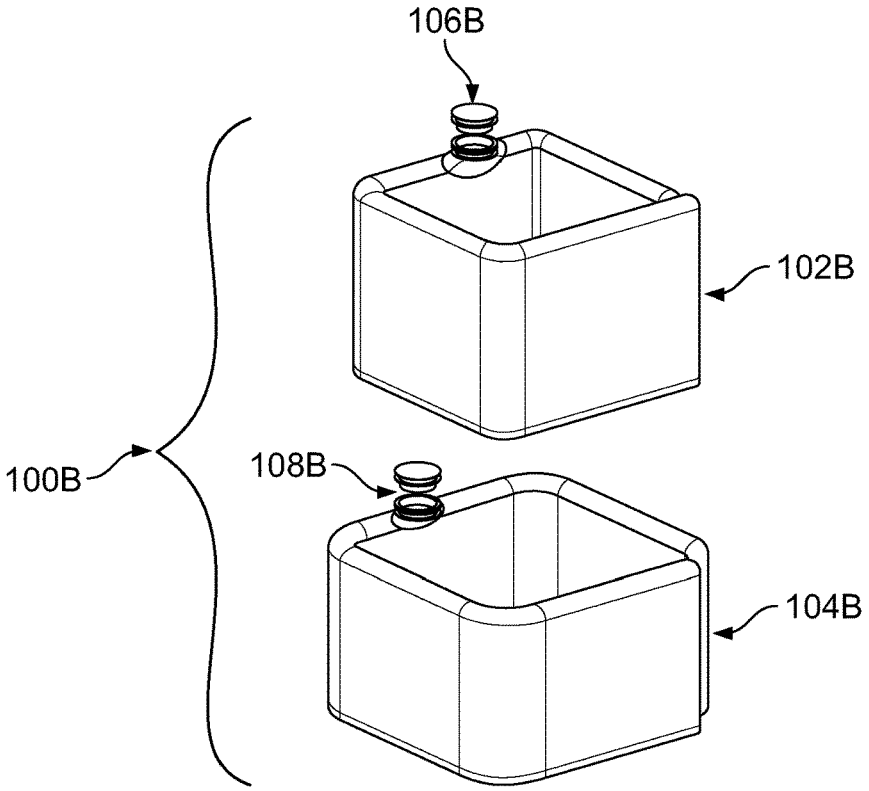
FIG. 16 is an exploded perspective view thereof.
Figure 17:
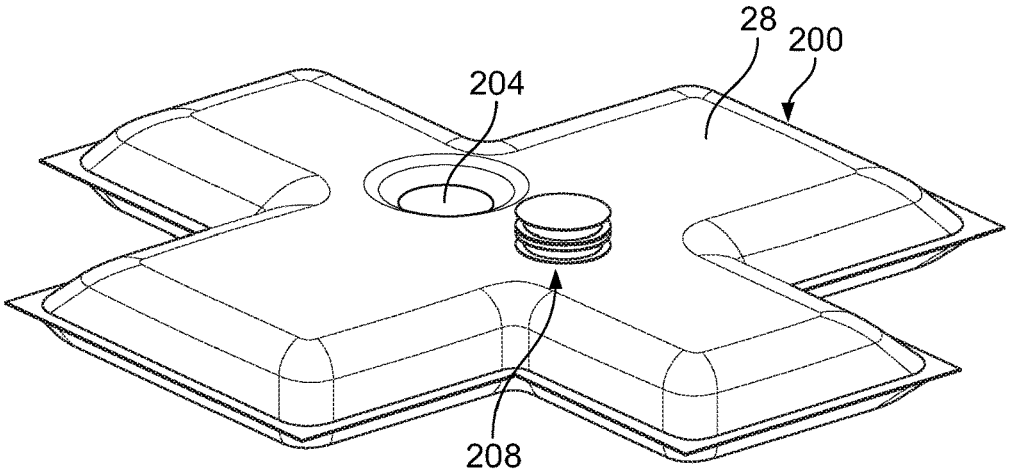
FIG. 17 is a perspective view of a third embodiment comprising a dual chamber PCM bladder formed as a single heat sealed construction.
Figure 18:
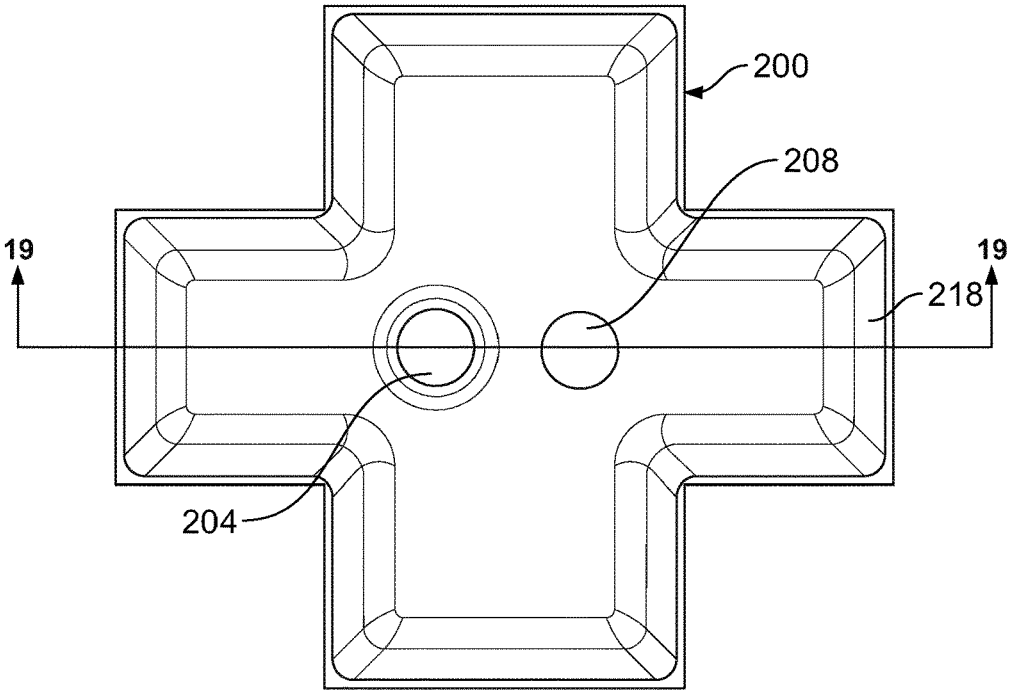
FIG. 18 is a top view thereof.

Yet another alternate version indicated at 100B in FIGS. 15-16, provides first and second linear PCM bladders 102B and 104B which are effective for overlaying the four side surfaces of the product box 16 leaving the top and bottom surface uncovered. The filling ports 106B, 108B on these linear PCM bladders are positioned in the side edges so that they are accessible from the top of the shipper.

In a third embodiment as illustrated in FIGS. 17-20, a dual chambered PCM bladder 200 is provided in a single heat sealed construction. The dual chamber PCM bladder 200 comprises a first bladder chamber 202 having a first filling port 204 and a second bladder chamber 206 having a second filling port 208. Each bladder chamber 202, 206 receives a flowable PCM 210, 212 preconditioned at a predetermined temperature.

Figure 19:
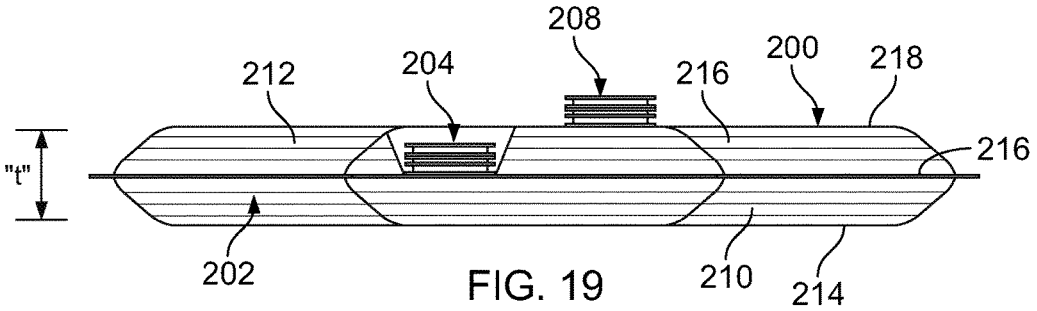
FIG. 19 is a cross-section view thereof taken along line 19-19 of FIG. 18.
Figure 20:
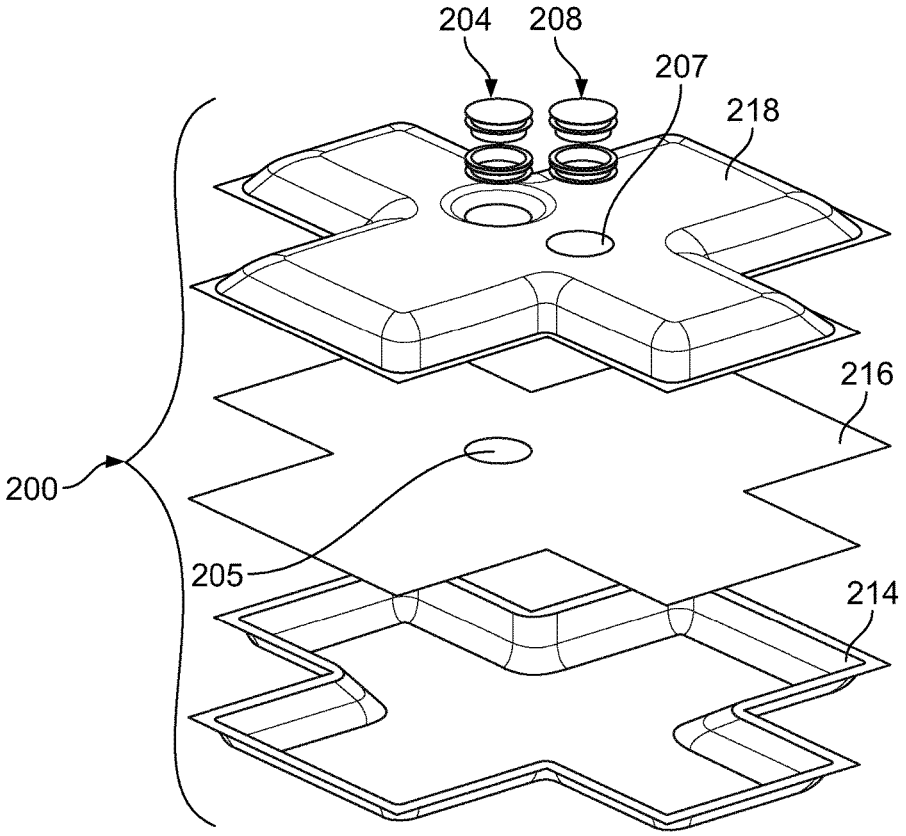
FIG. 20 is an exploded perspective view thereof.

The dual chambered bladder 200 comprises a lower sheet 214, a middle sheet 216 and an upper sheet 218 overlaid in substantially coextensive relation and sealed around the peripheral edges thereof to form the two chambers 202, 204. The first bladder chamber 202 is defined between the lower sheet 214 and the middle sheet 216 and the second bladder chamber 206 is defined between the middle sheet 216 and the upper sheet 218. The first filling port 204 is sealed at aperture 205 on the upper surface of the middle sheet 216 and the upper sheet 218 is sealed around the peripheral edge of the first filling port 204. The second filling port 208 is sealed at aperture 207 on the upper surface of the upper sheet 218 whereby the first and second filling ports 204, 208 are both accessible for filling from above the upper surface of the upper sheet 218. Referring to FIG. 19, the first and second bladder chambers 202, 206 are both configured so as to have a substantially uniform thickness "t" across its extent when filled with the flowable PCM's 210, 212.

As described hereinabove the PCM bladder 200 is preferably formed in the shape of a cross and is received into a product shipper 14 as described hereinabove.

Figure 21:
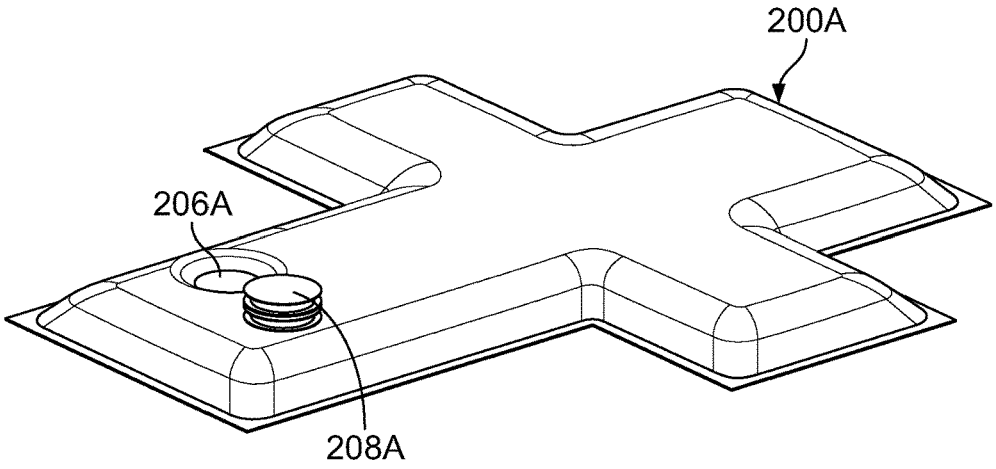
FIG. 21 is a perspective view of an asymmetrical dual chamber PCM bladder effective for overlaying six (6) sides of the product box.

An alternate version indicated at 200A in FIG. 21, provides asymmetrical first and second bladder chambers and effectively overlays all six (6) sides of the product box 16. The six-sided, dual-chamber bladder 200A is also received into a product shipper as described hereinabove.

Figure 22:
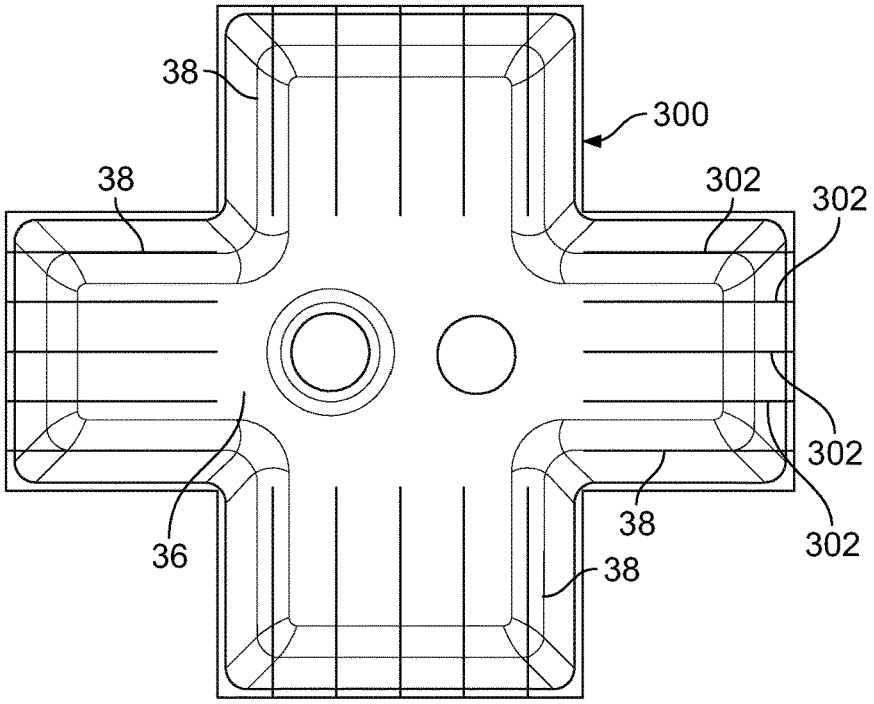
FIG. 22 is a perspective view of a fourth embodiment comprising a dual chamber bladder including a plurality of flutes which divide the bladders into a plurality of sections.

A fourth embodiment, as illustrated in FIG. 22, comprises a PCM bladder 300 that includes a plurality of flutes 302 formed by heat sealing the polyethylene sheets together. The flutes 302 divide the appendage portions 38 of the bladder 300 into a plurality of sections and provide support and stability for the PCM within the bladder 300. The bladder 300 may comprise a single chamber bladder or a dual chamber bladder, both as described hereinabove. The flutes 302 may extend vertically, as illustrated, or may be oriented horizontally, or in any other direction which is necessitated by the design of the shipper and/or bladder.

Figure 23:
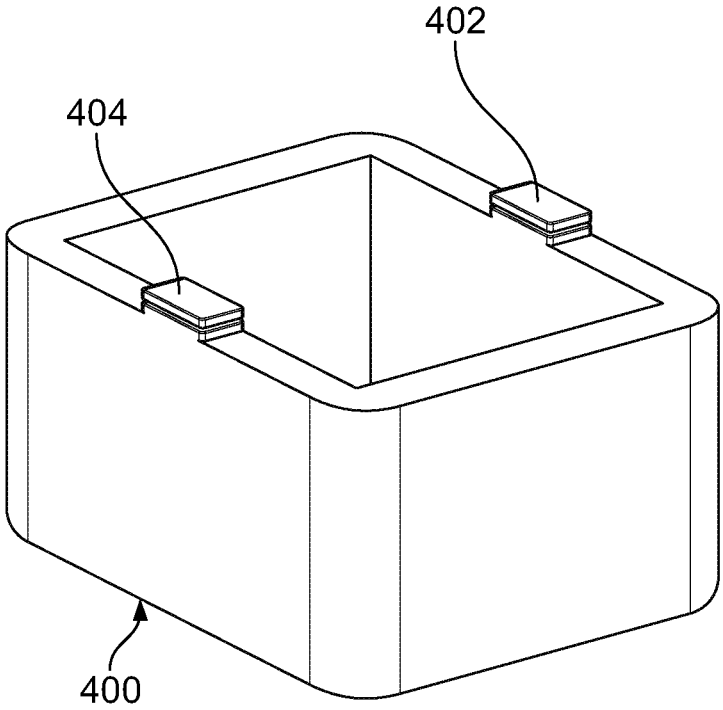
FIG. 23 is a perspective view of a fifth embodiment comprising a more rigid blow-molded PCM bladder.

A fifth embodiment, as illustrated in FIG. 23, comprises a slightly more rigid PCM bladder 400 formed from a blow-molded polyethylene material. The PCM bladder 400 may be a single chamber bladder containing a single PCM, or may be a dual chamber PCM bladder containing PCM's preconditioned at two different temperatures. The more rigid material helps maintain the shape of the bladder 400 and provides for a uniform thermal profile. In the configuration as shown, the PCM bladder is formed in the shape of an open box into which the product box (not shown) would be received. The filling ports 402 and 404 are located on the tops of the side walls so that they can be accessed from the top of the shipper.

It can therefore be seen that the present disclosure provides the following unique concepts: a novel phase change material (PCM) bladder for use in a temperature controlled product shipper; a PCM bladder that receives and holds a flowable PCM; a PCM bladder having a filling port that can be selectively accessed for filling of the bladder chamber with a PCM at the point of packing; a dual bladder system including overlaid first and second bladders which receive PCM's preconditioned at two different temperatures; a dual chamber PCM bladder which provides two different PCM's in a single layered construction; and a PCM bladder including flutes which divide the chamber into a plurality of sections to provide support and stability to the structure.

For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A temperature controlled shipper for shipping temperature sensitive products, said temperature controlled shipper comprising:

a product box having an outer surface including an outer proximal surface and an outer distal surface below said outer proximal surface;

an outer box, said product box being received within said outer box;

a phase change material bladder received within a cavity defined between said outer surface of said product box and an inner surface of said outer box, said bladder being formed in the shape of a cross having a central body portion and opposed appendage portions extending outwardly therefrom, said bladder having a filling port with a selectively removable stopper, said filling port extending upwardly from said central body portion of said bladder when received within said cavity, wherein said central body portion of said phase change material bladder is disposed over at least said outer proximal surface of said product box and said filling port extends upwardly from said central body portion and said outer proximal surface when assembled, said bladder being configured and arranged to receive through said filling port, at the time of packing, a flowable, brined ice-slurry phase change material preconditioned at a predetermined temperature, said bladder having a substantially uniform thickness when filled with said flowable phase change material whereby said bladder provides a substantially uniform thermal profile.

2. The shipper of claim 1 wherein said bladder further comprises a second bladder chamber having a second filling port.

3. The shipper of claim 2 wherein said first bladder chamber receives a phase change material preconditioned at a first temperature and said second bladder chamber receives a phase change material preconditioned at a second temperature.

4. The shipper of claim 2 wherein said first and second bladder chambers overlay each other in substantially coextensive adjacent relation.

5. The shipper of claim 3 wherein said first and second bladder chambers are each configured and arranged to have a substantially uniform thickness when filled with said flowable phase change material whereby said bladder provides a substantially uniform thermal profile.

6. The shipper of claim 1 wherein said opposed appendage portions are symmetrical, said central portion and said symmetrical opposed appendage portions cooperating to substantially overlay five adjacent surfaces of said product box.

7. The shipper of claim 1 wherein said opposed appendage portions are asymmetrical, said central portion and said asymmetrical opposed appendage portions cooperating to substantially overlay six adjacent surfaces of said product box.

8. A temperature controller shipper for shipping temperature sensitive products, said temperature controlled shipper comprising:

a product box having an outer surface including an outer proximal surface and an outer distal surface below said outer proximal surface;

an insulated liner comprising a base portion having a bottom wall, upwardly extending sidewalls, and an open top, said insulating box further comprising a lid receivable over said open top, said product box being received within said insulated liner; and a phase change material bladder received within a cavity defined between an outer surface of said product box and an inner surface of said insulated liner, said bladder being formed in the shape of a cross having a central body portion and opposed appendage portions extending outwardly therefrom, said bladder having a filling port with a selectively removable stopper, said filling port extending upwardly from said central body portion of said bladder when received within said cavity, wherein said central body portion of said phase change material bladder is disposed over at least said outer proximal surface of said product box and said filling port extends upwardly from said central body portion and said outer proximal surface of said product box when assembled, said lid being disposed above said filling port, said bladder being configured and arranged to receive through said filling port, at the time of packing, a flowable, brined ice-slurry phase change material preconditioned at a predetermined temperature, said bladder having a substantially uniform thickness when filled with said flowable phase change material whereby said bladder provides a substantially uniform thermal profile.

9. The shipper of claim 8 wherein said bladder further comprises a second bladder chamber having a second filling port.

10. The shipper of claim 9 wherein said first bladder chamber receives a phase change material preconditioned at a first temperature and said second bladder chamber receives a phase change material preconditioned at a second temperature.

11. The shipper of claim 9 wherein said first and second bladder chambers overlay each other in substantially coextensive adjacent relation.

12. The shipper of claim 9 wherein said first and second bladder chambers are each configured and arranged to have a substantially uniform thickness when filled with said flowable phase change material whereby said bladder provides a substantially uniform thermal profile.

13. The shipper of claim 8 wherein said opposed appendage portions are symmetrical, said central portion and said symmetrical opposed appendage portions cooperating to substantially overlay five adjacent surfaces of said product box.

14. The shipper of claim 8 wherein said opposed appendage portions are asymmetrical, said central portion and said asymmetrical opposed appendage portions cooperating to substantially overlay six adjacent surfaces of said product box.

15. The shipper of claim 8 further comprising an outer box, said insulated liner being received within said outer box.

* * * * *